US005907752A

United States Patent [19]

Kondoh

[11] Patent Number: 5,907,752

[45] **Date of Patent: *May 25, 1999**

[54] DEVICE FOR CLEANING A PHOTOCONDUCTIVE ELEMENT INCLUDED IN AN IMAGE FORMING APPARATUS

[75] Inventor: Ichiro Kondoh, Chigasaki, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/712,877

[22] Filed: Sep. 12, 1996

Related U.S. Application Data

[63] Continuation of application No. 08/339,248, Nov. 10, 1994, Pat. No. 5,583,625.

[30] Foreign Application Priority Data

Nov. 11, 1993 [JP] Japan ..... 5-282787

[51] Int. Cl.[6] ..... G03G 15/08; G03G 21/10; G03G 21/16

[52] U.S. Cl. ..... 399/120; 399/123; 399/358; 399/360

[58] Field of Search ..... 399/123, 120, 399/114, 345, 350, 351, 356, 357, 358, 360

[56] References Cited

U.S. PATENT DOCUMENTS

| | | | |
|---|---|---|---|
| 4,254,202 | 3/1981 | Matsumoto et al. . | |
| 4,470,694 | 9/1984 | Murakami et al. . | |
| 4,518,248 | 5/1985 | Nishikawa . | |
| 4,888,620 | 12/1989 | Fujino et al. . | |
| 4,985,734 | 1/1991 | Honda et al. . | |
| 4,987,446 | 1/1991 | Machimaru et al. . | |
| 5,126,799 | 6/1992 | Matsuura et al. . | |
| 5,204,720 | 4/1993 | Ishida et al. . | |
| 5,249,025 | 9/1993 | Nakazawa et al. | 399/350 X |
| 5,268,720 | 12/1993 | Saitoh et al. . | |
| 5,298,952 | 3/1994 | Kamijo et al. . | |
| 5,315,357 | 5/1994 | Kamijo et al. . | |
| 5,331,377 | 7/1994 | Matsuura et al. . | |
| 5,349,425 | 9/1994 | Kamijo et al. . | |
| 5,363,177 | 11/1994 | Nakano et al. . | |
| 5,475,479 | 12/1995 | Hatakeyama et al. . | |
| 5,489,747 | 2/1996 | Takenaka et al. . | |
| 5,583,625 | 12/1996 | Kondoh | 399/358 |
| 5,697,038 | 12/1997 | Hatta et al. | 399/358 |

FOREIGN PATENT DOCUMENTS

| | | |
|---|---|---|
| 30 05 455 A1 | 9/1981 | Germany . |
| 30 08 559 A1 | 9/1981 | Germany . |
| 39 41 506 | 6/1990 | Germany . |
| 42 23 147 | 1/1993 | Germany . |
| 44 22 635 A1 | 1/1995 | Germany . |
| 56-69676 | 6/1981 | Japan . |
| 60-84963 | 6/1985 | Japan . |
| 61-204670 | 9/1986 | Japan . |
| 62-170977 | 7/1987 | Japan . |
| 62-269189 | 11/1987 | Japan . |
| 63-56676 | 3/1988 | Japan . |
| 1-76074 | 3/1989 | Japan . |
| 1-315770 | 12/1989 | Japan . |
| 4-329577 | 11/1992 | Japan . |
| 5-142935 | 6/1993 | Japan . |

*Primary Examiner*—William Royer
*Attorney, Agent, or Firm*—Oblon, Spivak, McClelland, Maier & Neustadt, P.C.

[57] ABSTRACT

In an image forming apparatus using a cleaner/toner magazine (CTM) which has a waste toner tank and a fresh toner tank formed integrally with each other, a cleaning device has a cleaning blade which scrapes off toner left on a photoconductive element with an edge thereof. The toner removed by the cleaning blade is magnetically deposited on a rotatable magnet member whose outer periphery is magnetized. A scraper member contacts the magnet member in the waste toner tank and scrapes off the toner from the magnet member which is in rotation. As a result, the toner is collected in a collection space defined in the waste toner tank.

20 Claims, 8 Drawing Sheets

DEVICE FOR CLEANING A PHOTOCONDUCTIVE ELEMENT INCLUDED IN AN IMAGE FORMING APPARATUS

This is a Continuation of application Ser. No. 08/339,248 filed on Nov. 10, 1994, now U.S. Pat. No. 5,583,625.

BACKGROUND OF THE INVENTION

The present invention relates to a facsimile apparatus, copier, printer or similar image forming apparatus of the type using a cleaner/toner magazine (CTM) which has a waste toner tank and a fresh toner tank formed integrally with each other and, more particularly, to a cleaning device for removing toner remaining on a photoconductive element included in the apparatus and collecting it.

An image forming apparatus of the kind described often uses a CTM replaceably mounted to the apparatus and having a waste toner tank and a fresh toner tank constructed integrally with each other. The waste toner tank accommodates a cleaning device for removing toner left on a photoconductive element after image transfer and collecting it. Usually, such a cleaning device has a cleaning blade contacting the surface of the photoconductive element at an edge thereof, and a brush rotatable in contact with the edge of the blade. The toner is removed by the edge of the cleaning blade and then raked off by the brush into a collection space defined in the waste toner tank. The cleaning device with such a blade and brush collects the toner removed by the blade in the collection space more efficiently than a cleaning device having only the blade.

The brush has to be slightly bent at all times in order to rake off the toner into the waste toner tank. Usually, the brush has the brush portion thereof adhered to a support member made of plastic by a two-sided adhesive tape. The adhesive tape, however, sequentially comes off due to thermal stresses attributable to a fixing device which is located in the vicinity of the brush. As a result, the support member fails to firmly support the brush portion, sequentially lowering the collecting ability of the brush.

For a conventional cleaning device implemented as a CTM, a reference may be made to, for example, Japanese Patent Laid-Open Publication No. 5-210339 and corresponding copending U.S. Ser. No. 08/010,876 filed Jan. 29, 1993.

SUMMARY OF THE INVENTION

It is, therefore, an object of the present invention to provide a cleaning device capable of collecting toner from a photoconductive element surely and stably over a long period of time.

It is another object of the present invention to provide a CTM for an image forming apparatus and having a cleaning device made up of a cleaning blade and a brush for collection.

In accordance with the present invention, a device for cleaning the surface of a photoconductive element included in an image forming apparatus has a cleaning member for removing magnetic toner remaining on the surface of the photoconductive element, a collection chamber for collecting the toner removed by the cleaning member, a rotatable magnet member adjoining the cleaning means and conveying the toner removed by the cleaning means into the collection chamber by magnetically depositing the toner thereon, and a scraping member contacting the magnetic member for scraping off the toner deposited on the magnet member.

Also, in accordance with the present invention, a CTM replaceably mounted to an image forming apparatus has a waste toner tank comprising a cleaning device for cleaning the surface of a photoconductive element included in the image forming apparatus, and a fresh toner tank formed integrally with the waste toner tank and storing fresh toner to be replenished. The cleaning device has a cleaning member for removing magnetic toner remaining on the surface of the photoconductive element, a collection chamber for collecting the toner removed by the cleaning member, a rotatable magnet member adjoining the cleaning member and conveying the toner removed by the cleaning member into the collection chamber by magnetically depositing the toner thereon, and a scraping member contacting the magnetic member for scraping off the toner deposited on the magnet member.

Further, in accordance with the present invention, an image forming apparatus having a photoconductive element whose surface is to be cleaned has a cleaning device for removing magnetic toner remaining on the surface of the photoconductive element, a collection chamber for collecting the toner removed by the cleaning device, a rotatable magnet member adjoining the cleaning device and conveying the toner removed by the cleaning device into the collection chamber by magnetically depositing the toner thereon, and a scraping member contacting the magnetic member for scraping off the toner deposited on the magnet member.

Moreover, in accordance with the present invention, in an image forming apparatus having a replaceable CTM, the CTM has a waste toner tank comprising a cleaning device for cleaning the surface of a photoconductive element included in the image forming apparatus, and a fresh toner tank formed integrally with the waste toner tank and storing fresh toner to be replenished. The cleaning device has a cleaning member for removing magnetic toner remaining on the surface of the photoconductive element, a collection chamber for collecting the toner removed by the cleaning member, a rotatable magnet member adjoining the cleaning member and conveying the toner removed by the cleaning member into the collection chamber by magnetically depositing the toner thereon, and a scraping member contacting the magnetic member for scraping off the toner deposited on the magnet member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
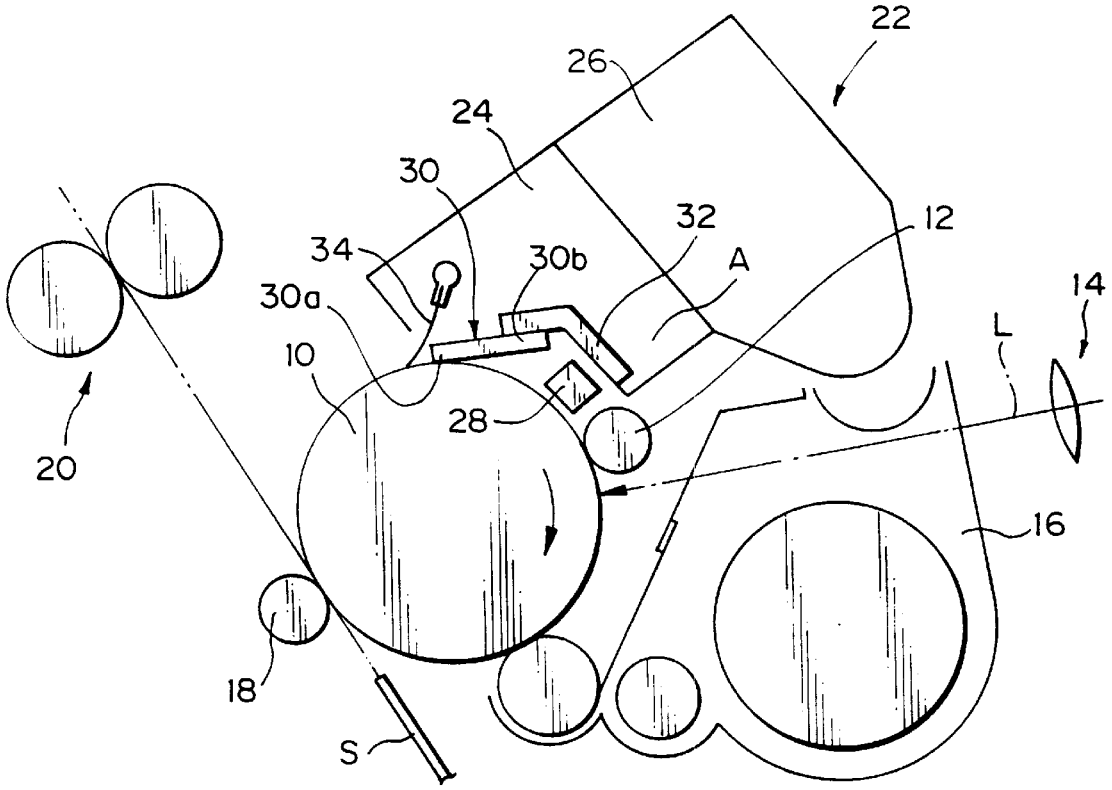
Fig. 1 PRIOR ART
FIG. 1 is a section of an image forming apparatus having a conventional cleaning device implemented as a CTM.

To better understand the present invention, a brief reference will be made to an image forming apparatus having a conventional cleaning device implemented as a CTM, shown in FIG. 1. As shown, the apparatus includes a photoconductive element in the form of a drum 10. A charger 12 uniformly charges the surface of the drum 10 to predetermined polarity. An exposing device, or optics, 14 electrostatically forms a latent image on the charged surface of the drum 10 with a laser beam L. A developing device 16 develops the latent image with toner to produce a corresponding toner image An image transfer device 18 transfers the toner image from the drum 10 to a sheet S. A fixing device 20 fixes the toner image on the sheet S. A CTM 22 is made up of a waste toner tank 24 and a fresh toner tank 26 constructed integrally with each other. After the image transfer, the toner left on the drum 10 is removed and collected in the waste toner tank 24. The fresh toner tank 26 stores fresh toner to be replenished into the developing device 16. The reference numeral 28 designates a discharger.

In the CTM 22, the waste toner tank 24 has thereinside a cleaning blade 30 contacting the surface of the drum 10 at the one or free end 30*a* thereof, a holder 32 holding the other end 30*b* of the blade 30, and a brush 34 rotably in contact with the end 30*a* of the blade 30 for collecting toner.

Figure 2:
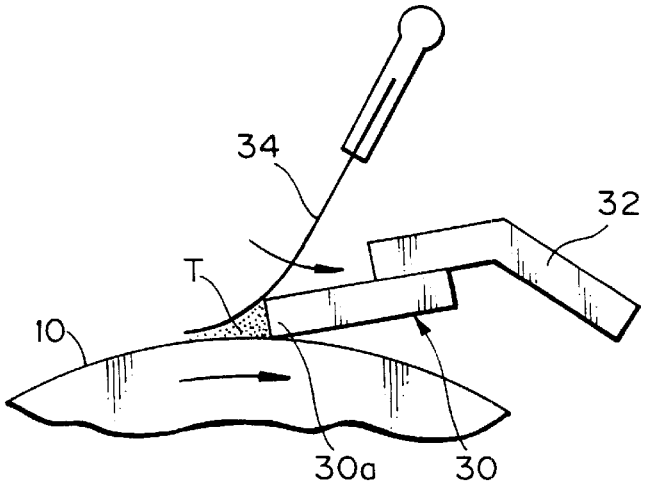
Fig. 2 PRIOR ART
FIG. 2 is a section showing a cleaning blade and a brush for collection included in the device of FIG. 1.

As shown in FIG. 2 specifically, toner T remaining on the drum 10 after image transfer is removed by the edge 30*a* of the cleaning blade 30. The brush 34, rotating in a direction indicated by an arrow in the figure, removes the toner T from the cleaning blade 30 and brings it into a collection space A, as shown in FIG. 1, defined in the waste toner tank 24. The CTM 22 is capable of collecting the remaining toner T in the collection space A more efficiently than a cleaning device which collects it only with the cleaning blade 30.

However, the prerequisite with the CTM 22 is that the brush 34 be slightly bent at all times in order to rake off the toner T into the waste toner tank 24. Usually, the brush 34 has the brush portion thereof adhered to a support member made of plastic by a two-sided adhesive tape. The adhesive tape sequentially comes off due to thermal stresses attributable to the fixing device 20 which is located in the vicinity of the brush 34. As a result, the support member fails to firmly support the brush portion, sequentially lowering the collecting ability of the brush 4.

Preferred embodiments of the cleaning device in accordance with the present invention will be described which are free from the problem discussed above.

Figure 3:
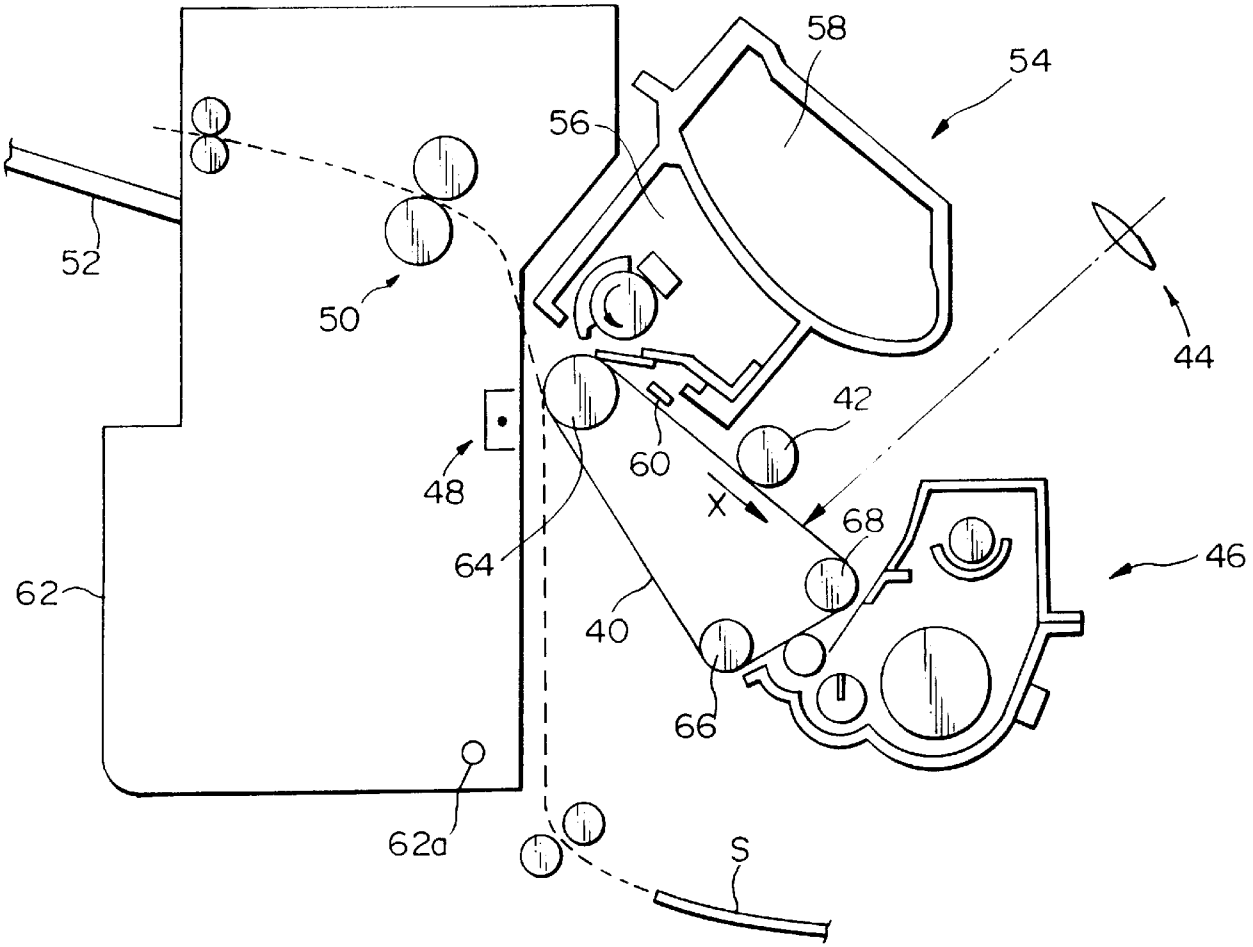
FIG. 3 is a section of an image forming apparatus to which the present invention is applicable.

Referring to FIG. 3, an image forming apparatus is shown to which the embodiments of the present invention are applicable. As shown, the apparatus has a photoconductive element implemented as a belt 40 rotatable in a direction X. A charger 42 uniformly charges the surface of the belt 40 to a predetermined polarity. An exposing device 44 electrostatically forms a latent image on the charged surface of the belt 40. A developing device 46 develops the latent image with toner. An image transfer device 48 transfers the resulting toner image to a sheet S fed from a sheet feed section, not shown. A fixing device 50 fixes the toner image on the sheet S. A tray 52 receives the sheet S coming out of the fixing device 50. A CTM 54 has a waste toner tank 56 and a fresh toner tank 58 formed integrally with each other. Toner remaining on the belt 40 after the image transfer is collected in the waste toner tank 56. The fresh toner tank 58 stores fresh toner to be replenished into the developing device 46. The reference numeral 60 designates a discharger. A cover 62 is rotatable about a shaft 62*a* to cover and uncover the section of the apparatus where the sheet S is driven out of the apparatus. The belt 40 is passed over pulleys 64, 66 and 68. The CTM 54 is replaceably mounted to the apparatus in an inclined position relative to the horizontal and may be so positioned by, for example, a device taught in U.S. Pat. No. 5,126,799.

Figure 4:
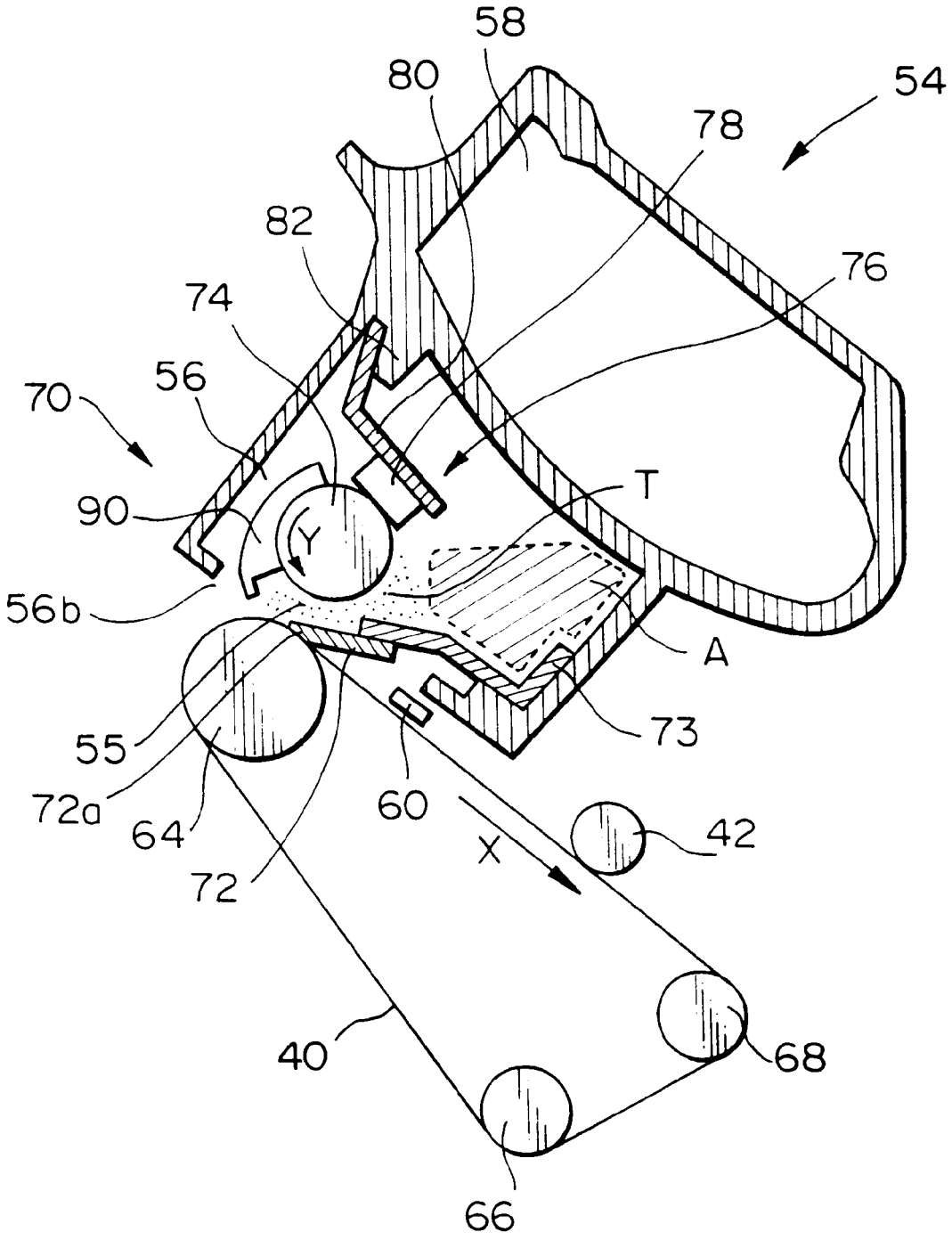
FIGS. 4 and 5 are sections each showing a preferred embodiment of the present invention.

FIG. 4 shows an embodiment of the present invention in detail. As shown, a cleaning device, generally 70, is built in the CTM 54, i.e., a waste toner tank 56 like the conventional device shown in FIGS. 1 and 2. The cleaning device 70 has a cleaning blade, or cleaning means, 72, a rotatable magnet member 74, and a scraper, or scraping means, 76. The blade 72 contacts the surface of the belt 40 at one, or free end, 72*a* thereof in order to remove toner T remaining on the belt 40. The magnet member 74 adjoins the blade 72 and has the outer periphery thereof magnetized. The magnet member 74 is rotatable in a direction indicated by an arrow Y in the figure. The scraper 76 scrapes off the toner T magnetically deposited on the magnet member 74. The blade 72 is supported by a holder 73 made of a magnetic material.

The magnet member 74 may be made of any suitable magnetic material, e.g., metal or resin. The scraper 76 is made up of a scraper member 78 for scraping off the toner T from the magnet member 74, a spring member 80 supporting the scraper member 78 while constantly biasing it toward the center of the magnet member 74, and a support member 82 supporting the spring member 80. The scraper member 78 may be made of felt, sponge, foam material or rubber while the spring member 80 may be implemented as a sheet of resin, rubber or similar nonmagnetic elastic material. The nonmagnetic elastic material will prevent the collected toner T from depositing on the spring member 80.

In operation, the edge 72*a* of the blade 72 contacting the belt 40 removes the toner T remaining on the belt 40. Then, the toner T is magnetically deposited on the magnet member 74 which is rotating counterclockwise, i.e., in the direction Y. As the magnet member 74 carrying the toner T thereon further rotates, the scraper member 78 of the scraping means 76 scrapes off the toner T from the magnet member 74 while introducing it in a collection space A defined in the waste toner tank 56. Specifically, since the CTM 54 is inclined relative to horizontal, the toner T removed by the scraper member 78 is collected in the collection space A due to gravity.

Figure 5:
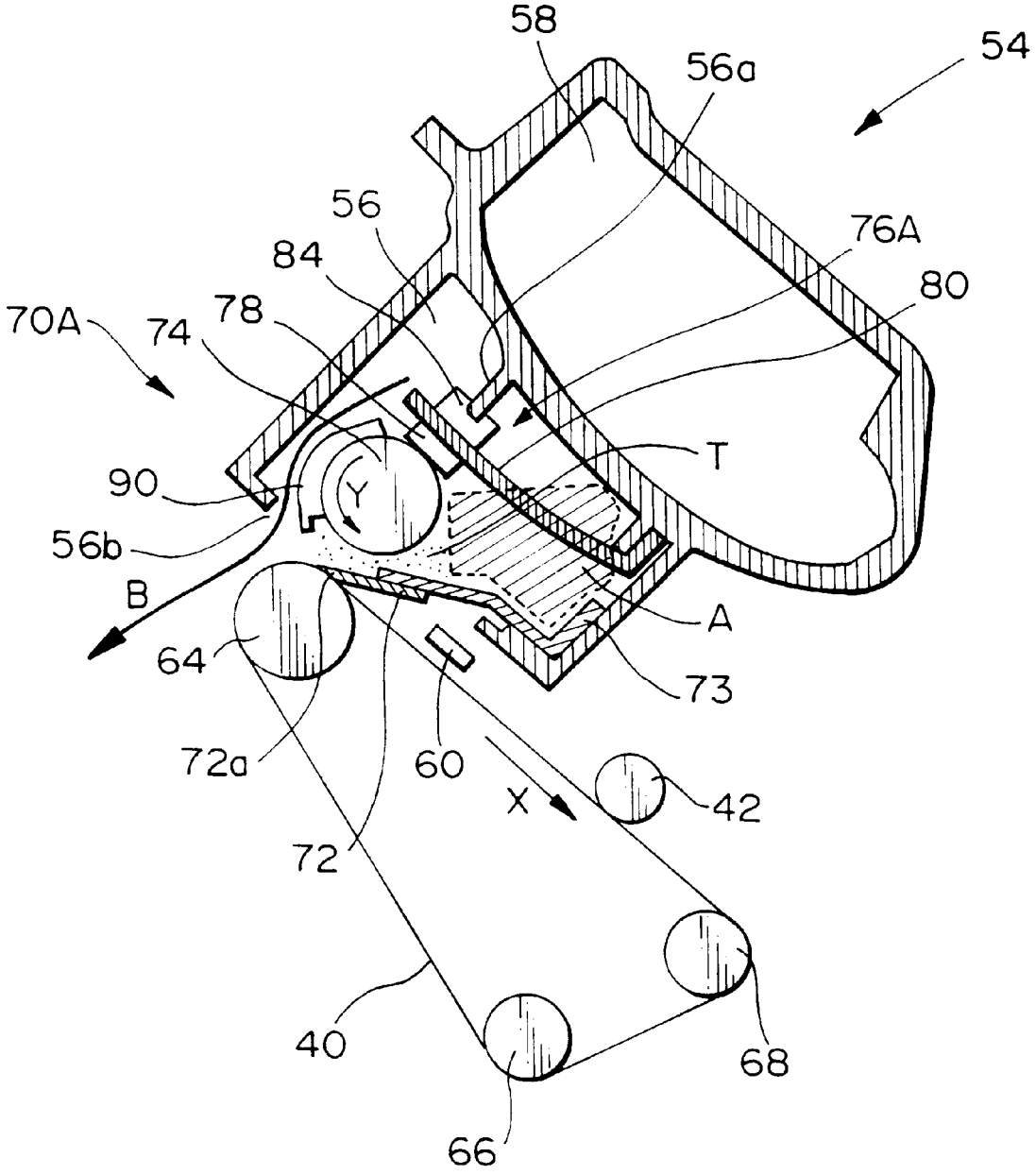

Referring to FIG. 5, an alternative embodiment of the present invention will be described. In FIG. 5, the same or similar constituent parts as or to the parts shown in FIG 4 are designated by the same reference numerals. As shown, a cleaning device, generally 70A, has scraping means 76A including the scraper member 78. An elastic member 84 is provided on the rear of the scraper member 78. The elastic member 84 abuts against a lug 56*a* extending out from the inner periphery of the waste toner tank 56. Generally, the toner T removed from the magnet member 74 by the scraper member 78 is apt to partly fly about in the waste toner tank 56. Moreover, when the waste toner tank 56 overflows, the toner T is apt to flow but of the cleaning device from the rear of the scraper member 78 via the magnet member 74 and an opening 56*b* formed through the tank 56, as indicated by an arrow B in the figure. In the illustrative embodiment, the elastic member 84 eliminates these problems.

In a modification of the embodiment of FIG. 4, the magnet member 74 closes the opening 56*b* of the waste toner tank 56, and the holder 73 supporting the blade 72 is made of a magnetic material. In such a configuration, the magnetic holder 73 cooperates with the magnet member 74 to generate a magnetic flux in the vicinity of a passage 55 through which the toner T is apt to flow out. The magnetic flux forms a magnetic shield blocking the passage 55. This successfully prevents the toner T collected in the tank 56 from flowing out.

Figure 6:
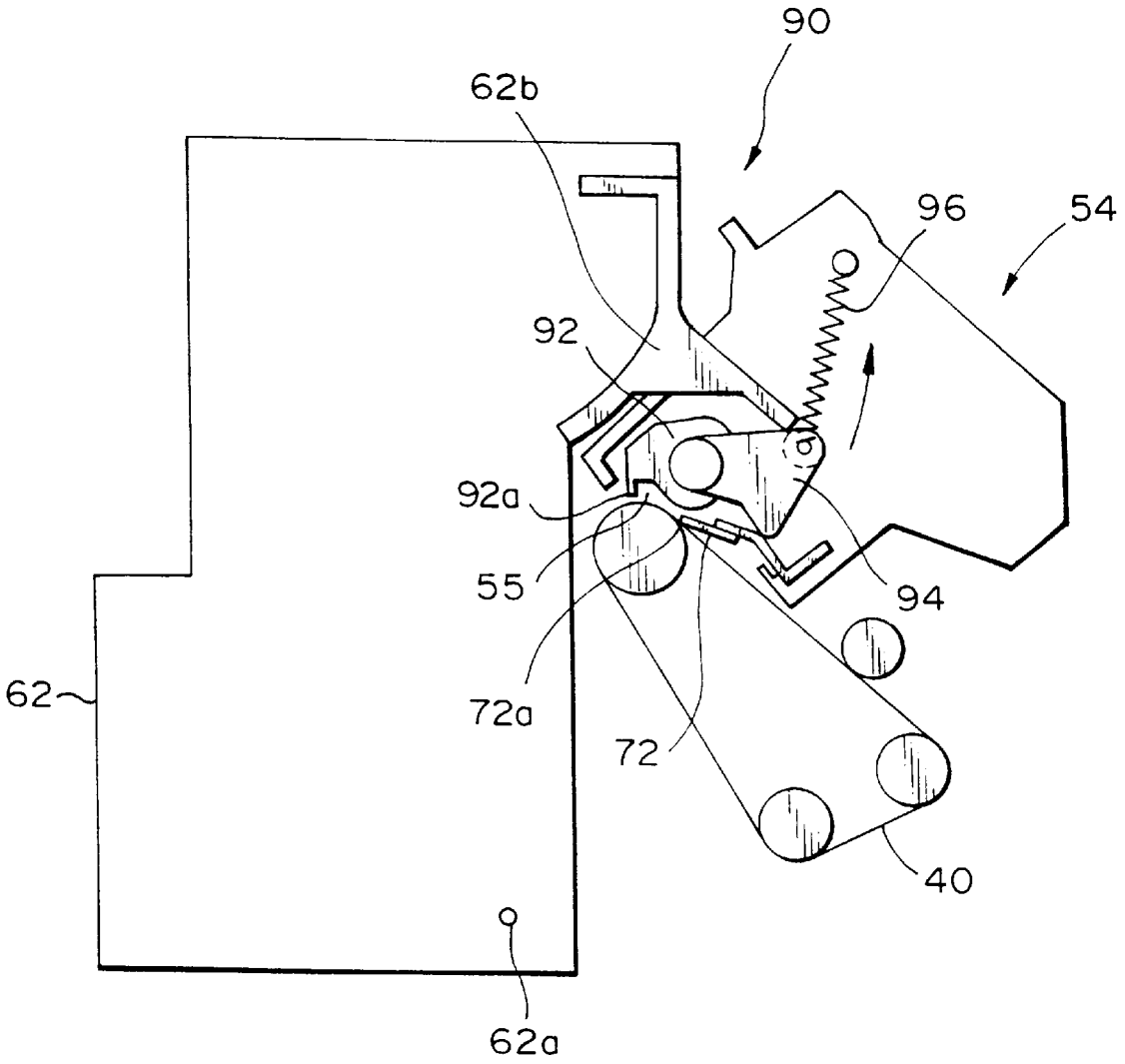
FIGS. 6 and 7 are sections showing a shutter mechanism included in the illustrative embodiments.
Figure 7:
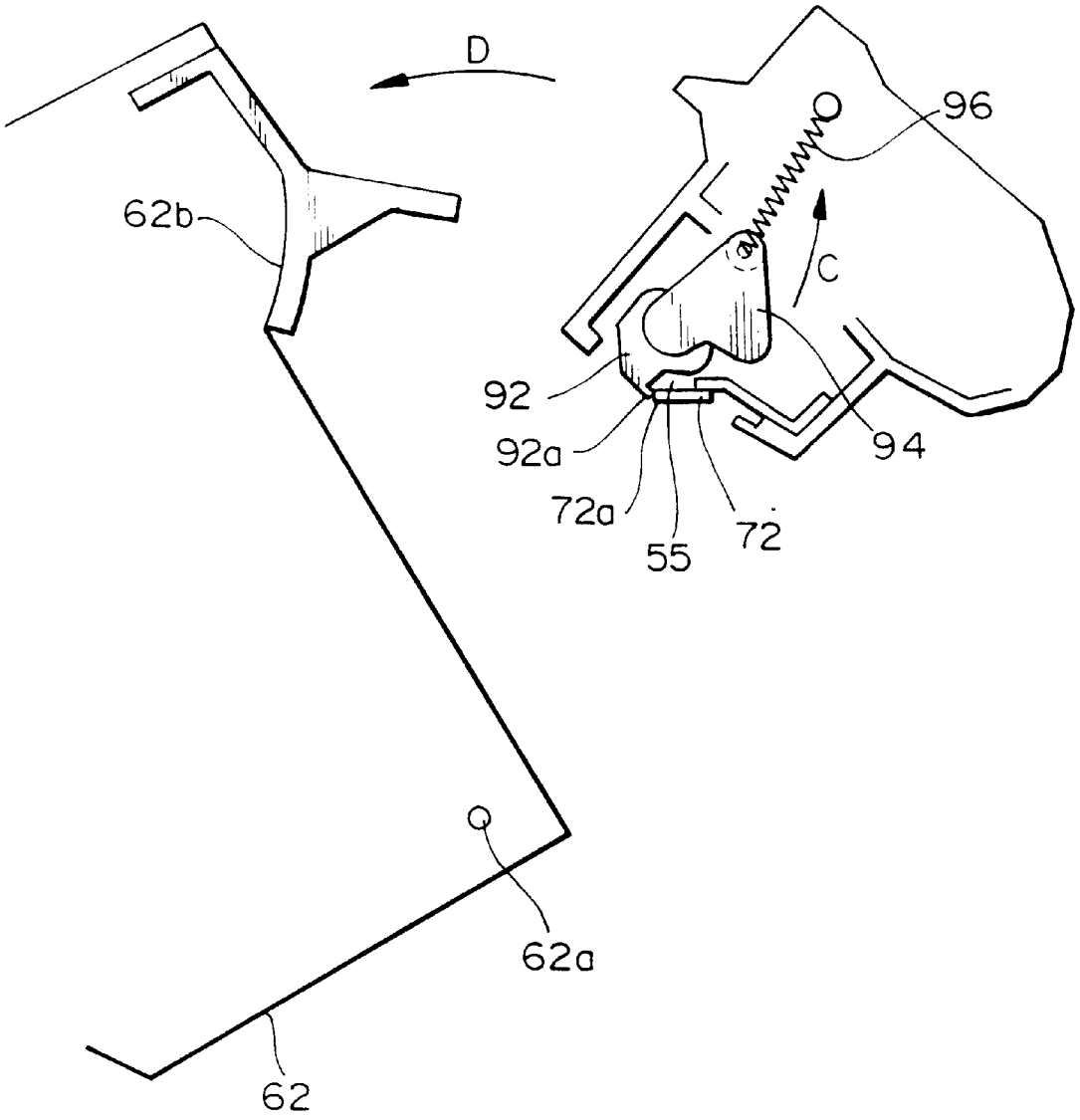

As shown in FIGS. 4 and 5, a shutter mechanism 90 may be disposed in the waste toner tank 56 of the CTM 54 in order to prevent the toner T from flying about. A specific construction of the shutter mechanism 90 is shown in FIGS. 6 and 7. As shown, the mechanism 90 has a shutter body 92, a lever 94 operatively connected to the shutter body 92, and a tension spring 96 constantly biasing the lever 94 in a direction C. As shown in FIG. 6, while the CTM 54 is mounted on the apparatus, the shutter body 92 remains in an open position since the lever 94 is pressed by a partition 62*b* mounted on the cover 62. Assume that the cover 62 is rotated, or opened, about the shaft 62*a* in a direction D, as shown in FIG. 7. Then, the lever 94 is released from the partition 62*b* of the cover 62 and rotated in the direction C due to the action of the spring 96. At this instant, the shutter body 92 is also rotated until part 92*a* thereof abuts against the edge 72*a* of the blade 72, as shown in FIG. 7. In this condition, the shutter body 92 prevents the toner T from flowing out through the passage 55. It is noteworthy that the toner T is prevented from depositing on the shutter mechanism 90 since the elastic member 84 prevents it from flowing beyond the magnetic member 74, as stated with reference to FIG. 5.

Figure 8:
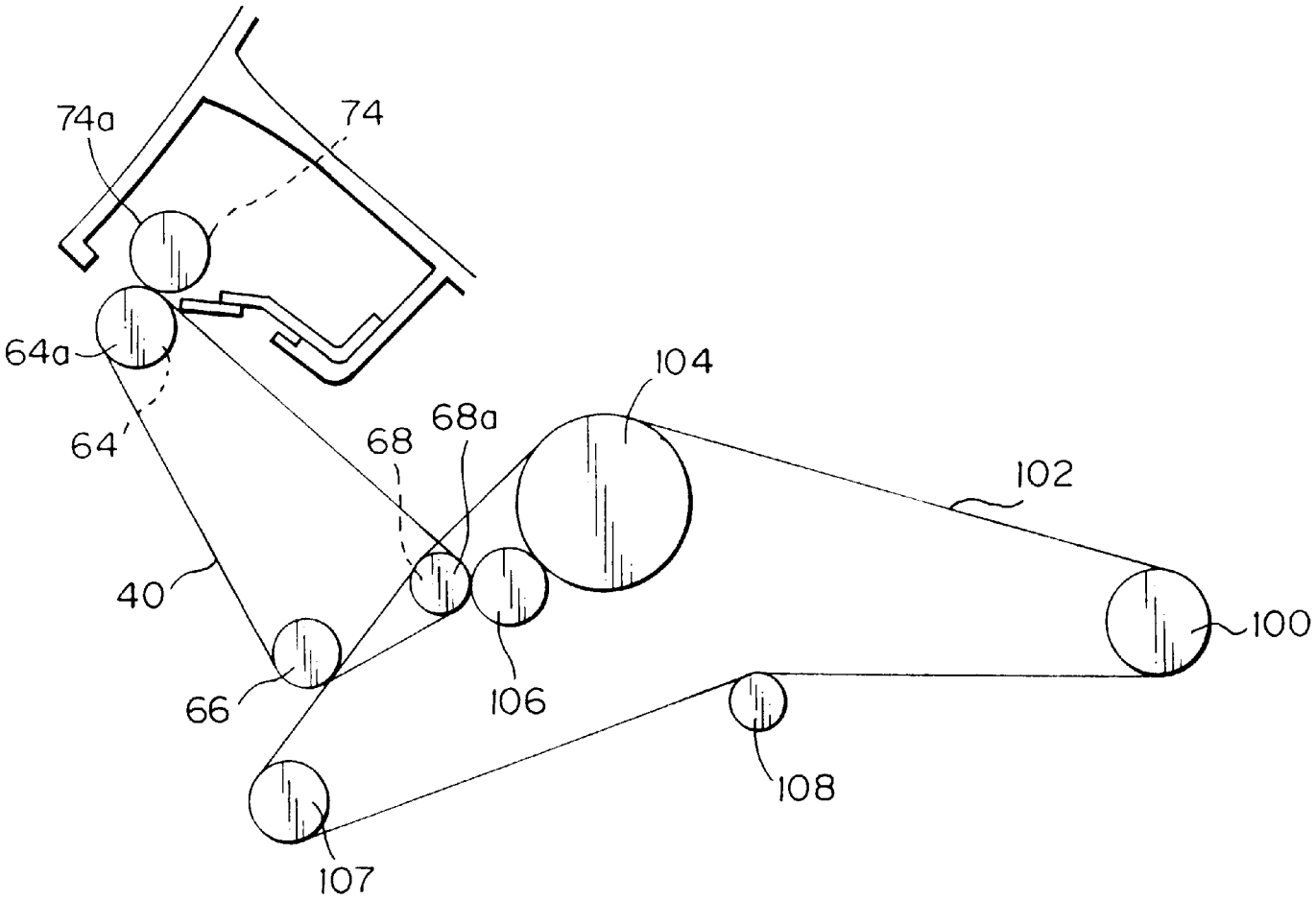
FIG. 8 shows a mechanism for driving a rotatable magnet member also included in the illustrative embodiments.

FIG. 8 shows a specific mechanism for driving the magnet member 74. As shown, the magnet member 74 is rotated by a main motor 100, which drives the belt 40, by way of the following transmission mechanism. The main motor 100 is drivably connected to a pulley 104 by a timing belt 102. The pulley 104 is held in mesh with a gear 106 which is, in turn, held in mesh with a gear 68*a* mounted on the pulley 68. Hence, the pulley 64 is driven by way of the belt 40. Since a gear 64*a* mounted on the pulley 64 is held in mesh with a gear 74*a* mounted on the magnet member 74, the magnet member 74 coaxial with the gear 74*a* is caused to rotate. The reference numerals 107 and 108 designate pulleys over which the timing belt 102 is also passed.

Figure 9:
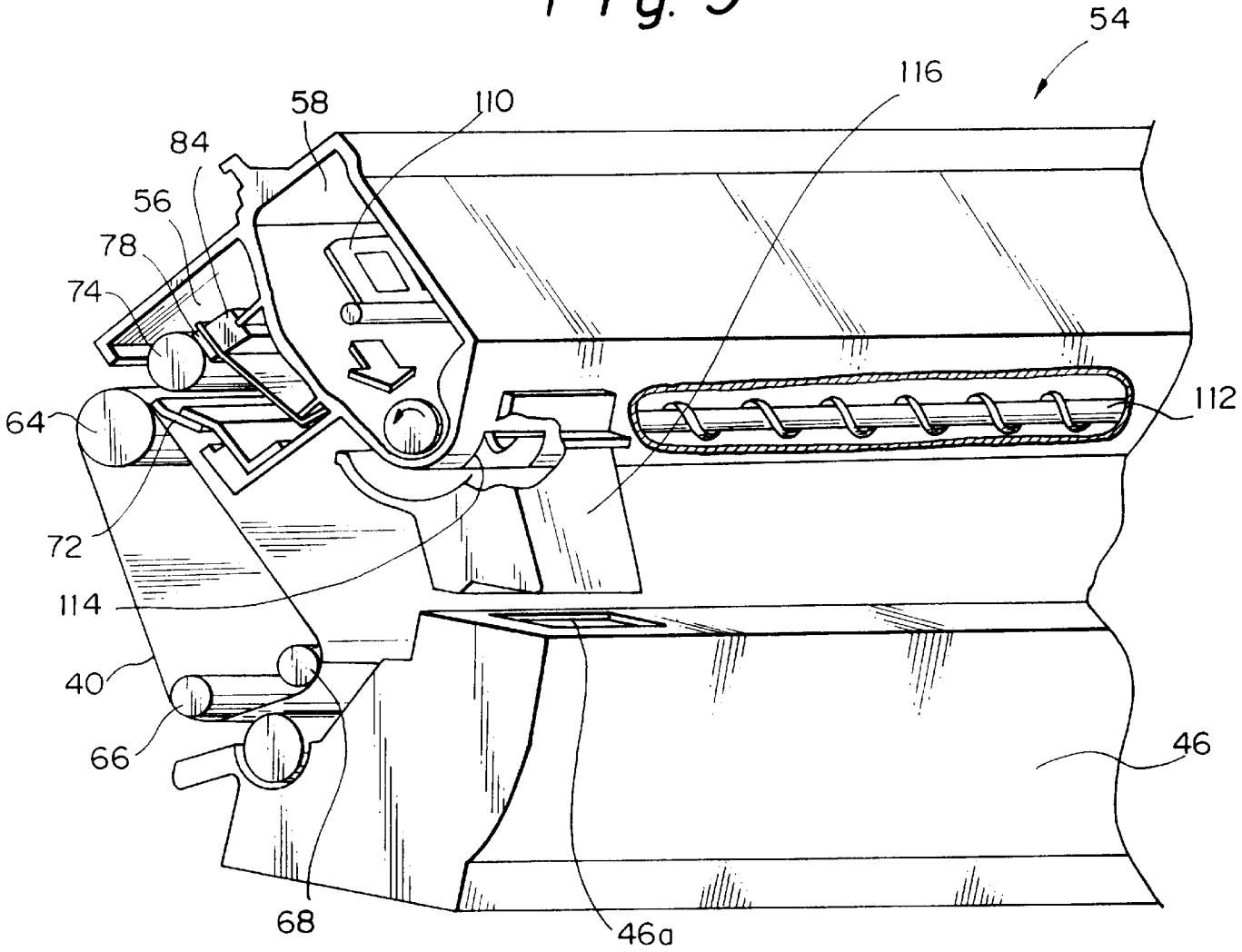
FIG. 9 is a perspective view of an image forming apparatus incorporating the cleaning device shown in FIG. 5.

FIG. 9 shows part of the image forming apparatus of FIG. 3, particularly the CTM 54 of FIG. 5, in a perspective view. As shown, the fresh toner tank 58 of the CTM 58 has an agitator 110 for agitating toner thereinside. The toner agitated by the agitator 110 is fed to a conveyor screw 112 due to gravity. The conveyor screw 112 in rotation conveys the toner to an opening 114 formed through the CTM 54. The toner reaching the opening 114 is routed through a duct 116 and an opening 46*a* formed through the developing device 46 into the device 46.

The embodiments shown and described have concentrated on the CTM 54 having the two tanks 56 and 58 formed integrally with each other and separated by a partition. Alternatively, the tanks 56 and 58 may be formed independently of each other and tied together by an arm or similar connecting member. Further, the embodiments are similarly practicable with an independent cleaning device, as distinguished from the CTM.

In the illustrative embodiments, the directions in which the magnet 74 and belt 40 rotate are dependent on the positional relation between the scraping means 76 or 76A and the collection space A. Regarding the relation shown in FIGS. 4 and 5, for example, the magnet member 74 and the belt 40 are rotated in the directions Y and X, respectively.

The magnet member 74 is implemented as a magnet roller made of nylon-based plastic. Although such a roller will slightly change in dimension due to thermal stresses attributable to the fixing device, the change is negligible and does not lower the collecting ability of the roller at all. Preferably, a clearance great enough to accommodate such a change should be provided at the design stage.

In summary, it will be seen that the present invention provides a cleaning device having various unprecedented advantages, as enumerated below.

(1) A rotatable magnet member is free from aging over a long period of time, insuring stable toner collection.

(2) A nonmagnetic spring member and a scraper member allow toner from being efficiently removed from the magnet member.

(3) An elastic member prevents the toner from flowing out by way of the rear of the scraper member and, therefore, prevents the toner collecting ability from decreasing.

(4) A magnetic flux generated by the magnet member prevents the toner from flowing out of the cleaning device.

Various modifications will become possible for those skilled in the art after receiving the teachings of the present disclosure without departing from the scope thereof.

What is claimed is:

1. A cleaner/toner magazine (CTM) mountable to an image forming apparatus having a photoconductive element, said CTM comprising:

a cleaning device for cleaning toner from a surface of the photoconductive element when the CTM is mounted to said image forming apparatus, said cleaning device comprising a cleaning element which engages the surface of the photoconductive element when the CTM is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

2. The CTM of claim 1, including a shutter which is movable to open and close the inlet of said waste toner tank, said shutter being configured to cooperate with said image forming apparatus to open the inlet when the CTM is connected to the image forming apparatus, wherein said scraper prevents toner in said waste toner tank from reaching the shutter.

3. The CTM device as claimed in claim 1, wherein said residual toner collecting means comprises a magnet member.

4. A cleaner/toner magazine (CTM) mountable to an image forming apparatus having a photoconductive element, said CTM comprising:

a fresh toner tank storing fresh toner to be replenished;

a cleaning device for cleaning toner from a surface of the photoconductive element when the CTM is mounted to said image forming apparatus, said cleaning device comprising a cleaning element which engages the surface of the photoconductive element when the CTM is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

5. The CTM of claim 4 including a shutter which is movable to open and close the inlet of said waste toner tank, said shutter being configured to cooperate with said image forming apparatus to open the inlet when the CTM is connected to the image forming apparatus, wherein said scraper prevents toner in said waste toner tank from reaching the shutter.

6. The CTM device as claimed in claim 4, wherein said residual toner collecting means comprises a magnet member.

7. An image forming apparatus comprising:

a photoconductive element;

a cleaner/toner magazine (CTM) mounted in the image forming apparatus for receiving toner from the photoconductive element, said CTM comprising a cleaning device for cleaning toner from a surface of the photoconductive element, said cleaning device comprising a cleaning element which engages the surface of the photoconductive element when the CTM is mounted to said image forming apparatus to remove toner thereon, a waste toner tank having an inlet for receiving toner removed by said cleaning element, a roller-shaped residual toner collecting means in said waste toner tank for conveying the toner removed by said cleaning element into said waste toner tank, and a scraper mounted in said waste toner tank wherein said scraper has a scraping portion, and wherein said scraping portion elastically contacts said residual toner collecting means so as to scrape toner from said residual toner collecting means; and an engaging element which opens the inlet when the CTM is connected to the image forming apparatus.

8. The image forming apparatus of claim 7 including a shutter which is movable in cooperation with said engaging element to open the inlet of said waste toner tank, wherein said scraper prevents toner in said waste toner tank from reaching the shutter.

9. The image forming apparatus of claim 8 wherein said CTM includes a fresh toner tank.

10. The image forming apparatus as claimed in claim 7, wherein said residual toner collecting means comprises a magnet member.

11. A cleaner/toner magazine (CTM) mountable to an image forming apparatus having a photoconductive element, said CTM comprising:

cleaning means for cleaning toner from a surface of the photoconductive element when the CTM is mounted to said image forming apparatus;

a waste toner tank having an inlet for receiving toner removed by said cleaning means;

a roller-shaped residual toner collecting means in said waste toner tank for conveying the toner removed by said cleaning means into said waste toner tank; and a scraper mounted in said waste toner tank, wherein said scraper has a scraping portion, and wherein said scraping portion elastically contacts said residual toner collecting means so as to scrape toner from said residual toner collecting means.

12. The CTM of claim 11 including shutter means for cooperating with said image forming apparatus to open the inlet when the CTM is connected to the image forming apparatus, wherein said scraper elastically prevents toner in said waste toner tank from reaching the shutter means.

13. The CTM of claim 12, further including a fresh toner tank.

14. The CTM as claimed in claim 11, wherein said residual toner collecting means comprises a magnet member.

15. An image forming apparatus comprising:

a cleaner/toner magazine (CTM) mountable to said image forming apparatus having a photoconductive element;

a cleaning device for cleaning toner from a surface of the photoconductive element when the CTM is mounted to said image forming apparatus, said cleaning device comprising a cleaning element which engages the surface of the photoconductive element when the CTM is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

16. An image forming apparatus comprising:

a cleaner/toner magazine (CTM) mountable to said image forming apparatus having a photoconductive element;

a fresh toner tank storing fresh toner to be replenished;

a cleaning device for cleaning toner from a surface of the photoconductive element when the CTM is mounted to said image forming apparatus, said cleaning device comprising a cleaning element which engages the surface of the photoconductive element when the CTM is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

17. An image forming apparatus comprising:

a cleaner/toner magazine (CTM) mountable to said image forming apparatus having a photoconductive element;

cleaning means for cleaning toner from a surface of the photoconductive element when the CTM is mounted to said image forming apparatus;

a waste toner tank having an inlet for receiving toner removed by said cleaning means;

a roller-shaped residual toner collecting means in said waste toner tank for conveying the toner removed by said cleaning means into said waste toner tank; and a scraper mounted in said waste toner tank, wherein said scraper has a scraping portion, and wherein said scraping portion elastically contacts said residual toner collecting means so as to scrape toner from said residual toner collecting means.

18. A cleaning device mountable to an image forming apparatus having a photoconductive element, said cleaning device comprising:

cleaning means for cleaning toner from a surface of the photoconductive element when the cleaning device is mounted to said image forming apparatus, said cleaning means comprising a cleaning element which engages the surface of the photoconductive element when the cleaning device is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

19. A cleaning device mountable to an image forming apparatus having a photoconductive element, said cleaning device comprising:

a fresh toner tank storing fresh toner to be replenished;

cleaning means for cleaning toner from a surface of the photoconductive element when the cleaning device is mounted to said image forming apparatus, said cleaning means comprising a cleaning element which engages the surface of the photoconductive element when the cleaning device is mounted to said image forming apparatus to remove toner thereon;

a waste toner tank having an inlet for receiving toner removed by said cleaning element;

a roller-shaped residual toner collecting means in said waste toner tank for conveying the toner removed by said cleaning element into said waste toner tank; and a scraper mounted in said waste toner tank, wherein said scraper has a scraping portion, and wherein said scraping portion elastically contacts said residual toner collecting means so as to scrape toner from said residual toner collecting means.

20. A cleaning device mountable to an image forming apparatus having a photoconductive element, said cleaning device comprising:

cleaning means for cleaning toner from a surface of the photoconductive element when the cleaning device is mounted to said image forming apparatus;

a waste toner tank having an inlet for receiving toner removed by said cleaning means;

a roller-shaped residual toner collecting means in said waste toner tank for conveying the toner removed by said cleaning means into said waste toner tank; and a scraper mounted in said waste toner tank, wherein said scraper has a scraping portion, and wherein said scraping portion elastically contacts said residual toner collecting means so as to scrape toner from said residual toner collecting means.

* * * * *